US008098866B2

(12) United States Patent
Gommel et al.

(10) Patent No.: US 8,098,866 B2
(45) Date of Patent: Jan. 17, 2012

(54) RECEIVER DEVICE WITH MANIPULABLE SOUND OUTLET DIRECTION

(75) Inventors: Uli Gommel, Erlangen (DE); Hartmut Ritter, Neunkirchen am Brand (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 839 days.

(21) Appl. No.: 12/221,433

(22) Filed: Jul. 31, 2008

(65) Prior Publication Data

US 2009/0034770 A1 Feb. 5, 2009

(30) Foreign Application Priority Data

Aug. 3, 2007 (DE) ..... 10 2007 036 567

(51) Int. Cl.
*H04R 25/00* (2006.01)

(52) U.S. Cl. ..... 381/330; 381/313; 381/324; 381/325; 381/328; 381/329

(58) Field of Classification Search ..... 381/313, 381/324, 325, 329, 328, 330
See application file for complete search history.

(56) References Cited

U.S. PATENT DOCUMENTS

| | | | | |
|---|---|---|---|---|
| 3,983,336 | A | 9/1976 | Malek et al. | |
| 5,701,348 | A | 12/1997 | Shennib et al. | |
| 5,960,095 | A | 9/1999 | Chang | |
| 6,212,283 | B1 * | 4/2001 | Fletcher et al. | 381/313 |
| 6,741,719 | B1 | 5/2004 | Orten | |
| 7,372,972 | B2 | 5/2008 | Ach-Kowalewski et al. | |
| 7,706,557 | B2 * | 4/2010 | Saltykov | 381/324 |
| 2005/0190940 | A1 | 9/2005 | Ach-Kowalewski et al. | |

FOREIGN PATENT DOCUMENTS

| | | | |
|---|---|---|---|
| CH | 648182 | A5 | 2/1985 |
| DE | 199 43 809 | A1 | 3/2001 |
| DE | 10 2004 009 268 | B3 | 10/2005 |
| WO | 9621334 | A1 | 7/1996 |
| WO | 0008893 | A1 | 2/2000 |

* cited by examiner

*Primary Examiner* — Andy Huynh

(57) ABSTRACT

Provided is a receiver device with an earpiece for securing the receiver device in an auditory canal. The receiver device further comprises a receiver with a sound outlet direction and an adapter for affixing the receiver in the earpiece, with a sound from the receiver being conducted through the adapter. The adapter diverts the sound from the sound outlet direction in a divergent direction.

7 Claims, 3 Drawing Sheets

RECEIVER DEVICE WITH MANIPULABLE SOUND OUTLET DIRECTION

CROSS REFERENCE TO RELATED APPLICATIONS

This application claims priority of German application No. 10 2007 036 567.7 DE filed Aug. 3, 2007, which is incorporated by reference herein in its entirety.

FIELD OF INVENTION

The present invention relates to a receiver device for a hearing apparatus having an earpiece for securing the receiver device in an auditory canal, a receiver with a preferred sound outlet direction, and an adapter for affixing the receiver in the earpiece, with a sound from the receiver being conducted through the adapter. The term hearing apparatus is understood here to refer in particular to a hearing device. However the term may also include other wearable acoustic devices such as headsets, earphones and the like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Hearing devices with external receivers are essentially designed such that a receiver unit including a receiver is replaceably mounted in an individually-shaped otoplastic. An adapter is required for this purpose which accommodates a head element that protrudes from the receiver unit and thus affixes the receiver unit in the otoplastic. This produces a long, rigid structure that is further extended by means of a cerumen protection element that can optionally be built into the hearing device.

SUMMARY OF INVENTION

The typical human auditory canal has a more or less strongly curved entrance. The use of small and short receivers is therefore advised. However greater amplifications require long and/or large receivers, which on the whole cause the otoplastic to have a rigid, long structure. This can give rise to a problem whereby optimal adjustment of the receiver unit to match the auditory canal cannot be performed due to the receiver unit's long structure. In the case of an auditory canal that is too strongly curved, an individually shaped otoplastic with an external receiver is often dispensed with. Furthermore there are difficulties when the sound produced by the receiver in a strongly curved auditory canal is emitted against a wall of the auditory canal. In this instance the disadvantage occurs that the sound is too severely attenuated by the wall.

The object of the present invention is thus to provide a receiver device for a hearing apparatus, with said receiver device enabling a reliable adjustment of the sound outlet to match an auditory canal.

The publication DE 10 2004 009 268 B3 discloses an ear insert for a receiver system. The ear insert comprises a molded body and a receiver that is removably arranged in the molded body. A sound outlet is arranged here between the receiver and the side of the molded body that faces the eardrum when the ear insert is in the auditory canal. The sound outlet is also formed in a capsule and has the shape of an exponential horn.

The publication DE 1 99 43 809 A1 discloses a hearing device with an otoplastic that forms a housing shell of the hearing device and that is produced to match an impression of the outer auditory canal of the user. The otoplastic contains a receiver that converts an electrical signal into a sound wave. In this known hearing device a protruding body is provided that is arranged at the inner end of the otoplastic on the eardrum side. In this way, the protruding body protrudes into a space in the auditory canal between the otoplastic and the eardrum. The protruding body is held by a connecting tube that is inserted at the inner end of the otoplastic and protrudes into a sound channel of the protruding body.

This object is inventively achieved by means of a receiver device for a hearing apparatus having an earpiece for securing the receiver device in an auditory canal, a receiver with a preferred sound outlet direction, and an adapter for affixing the receiver in the earpiece, with a sound from the receiver being conducted through the adapter, and with the adapter being designed such that it diverts the sound from the preferred sound outlet direction in a divergent direction.

Thus not only an adjustment of the receiver device to match the shape of the auditory canal, but also a better adjustment to suit the angle at which sound enters the auditory canal, is advantageously achieved. Accordingly the sound outlet direction of the receiver can be diverted such that the sound is output by the receiver device at least virtually in the direction in which the auditory canal extends. In this way sound reflections against the walls of the auditory canal are largely avoided and obstacle-free propagation of the sound toward the eardrum is enabled.

The adapter is preferably formed in a curve in order to divert the preferred sound outlet direction in the divergent direction. A curvature of the adapter can be designed easily and cost-effectively. A further advantage of the embodiment consists in emitting, through the curved form of the adapter, the sound signal output by the receiver particularly precisely in the direction of the auditory canal.

According to a further favorable embodiment of the receiver device the adapter can be realized like a bellow. A bellow-type embodiment of the adapter makes it possible for the curvature of the adapter to be configured variably and thus for the adjustment to be improved further. The curvature of the adapter can thus be designed individually according to the shape of the auditory canal.

According to a highly preferred embodiment of the receiver device the adapter is realized with a curve or like a bellow, with a spherical directing element with an end-to-end opening for allowing sound to pass through being additionally mounted rotatably in the adapter, with the end-to-end opening in the spherical directing element forming a sound outlet opening of the earpiece, and with the spherical directing element being designed to divert the sound from the preferred sound outlet direction in the divergent direction. Thus the earpiece can be individually shaped even if the auditory canal is very strongly curved. Because an adapter that is too highly curved is very difficult to plug into an otoplastic, an adapter e.g. that is curved around 15° can be inserted if a curvature of 30° is to be achieved, with the remaining 15° being taken over by the spherical directing element.

The spherical directing element with the end-to-end opening for allowing sound to pass through can as an alternative to the curvature or to the bellow-type form of the adapter be mounted rotatably in the adapter, with the end-to-end opening of the spherical directing element also continuing to form a sound outlet opening of the earpiece and with the spherical directing element being designed to divert the sound from the preferred sound outlet direction in the divergent direction. This embodiment of the receiver device is particularly suited to a less strongly curved auditory canal. Thus the sound outlet direction can be configured so that the sound is not reflected by the auditory canal and is not attenuated.

According to a further especially advantageous embodiment of the receiver device a cerumen protection element is integrated in the adapter or in the spherical directing element. The sound outlet opening of the receiver device and in particular the receiver are protected against cerumen by the cerumen protection element.

BRIEF DESCRIPTION OF THE DRAWINGS

The present invention is described in more detail with reference to the appended drawings, in which.

DETAILED DESCRIPTION OF INVENTION

Figure 1:
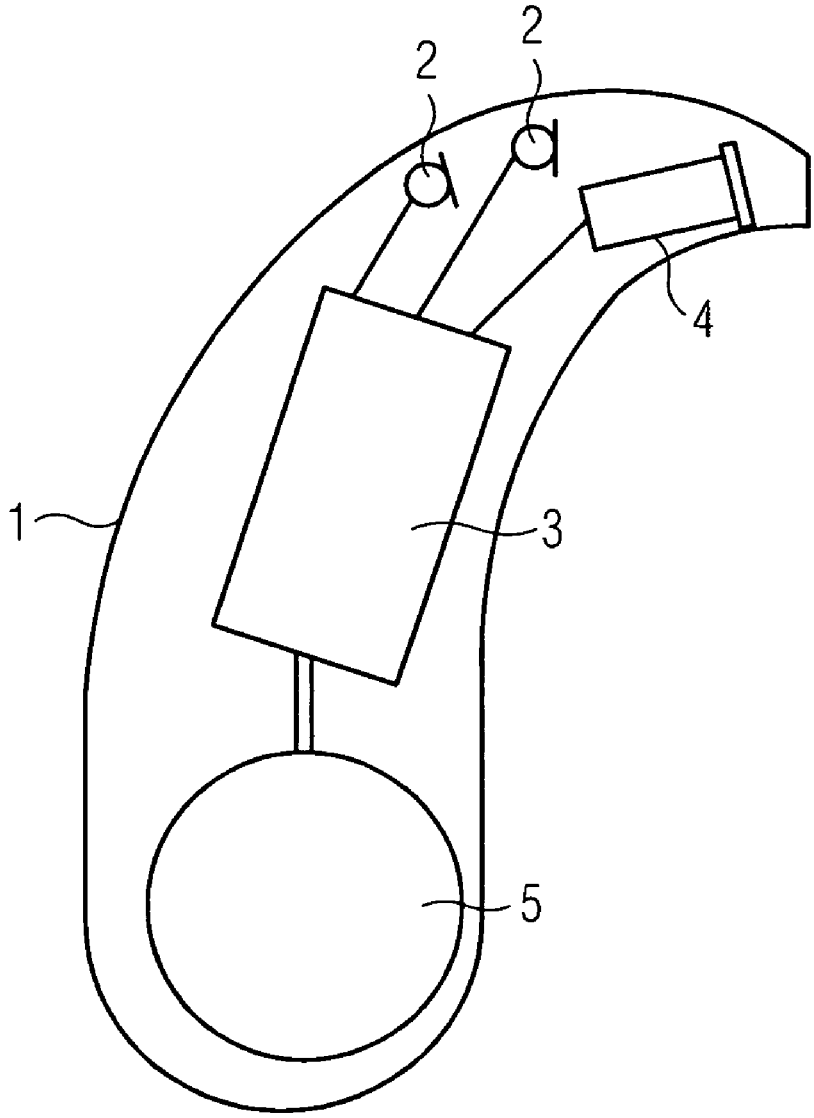
FIG 1 (Prior art)
FIG. 1 shows a schematic configuration of a behind-the-ear hearing device according to the prior art.
Figure 2:
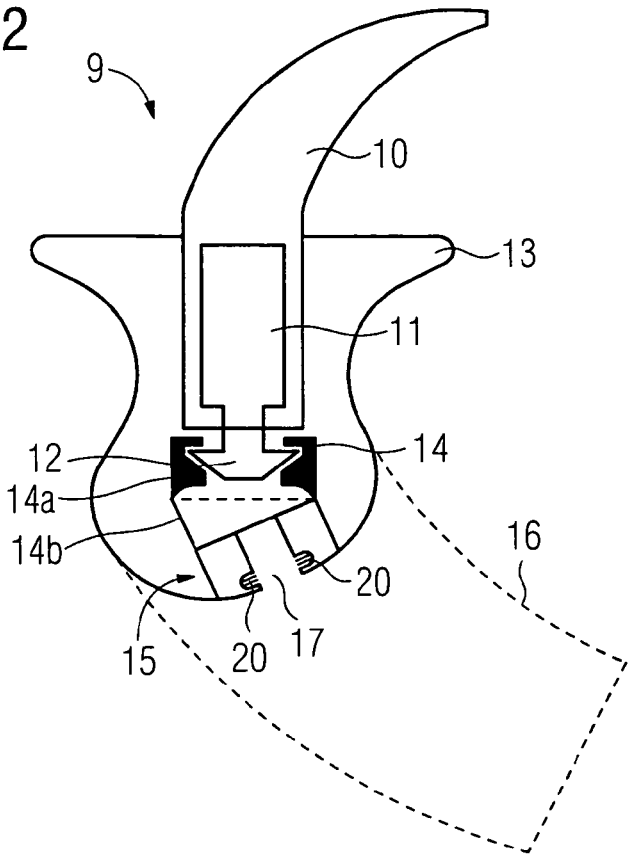
FIG. 2 shows an inventive receiver device according to a first exemplary embodiment.

According to a first exemplary embodiment reproduced in FIG. 2 a receiver device 9 according to the invention comprises an otoplastic 13 into which is replaceably mounted a receiver unit including a receiver housing 10 and a receiver 11. Instead of the otoplastic another earpiece, e.g. a so-called "ear tip" that is not individually shaped, can also be inserted. The otoplastic 13 can be inserted into a human auditory canal. The receiver 11 has a truncated conical sound output 12 that protrudes from the receiver housing 10 and is taken in by an adapter 14 and held in a ring-shaped enclosure. The objective of the adapter 14 here is to affix the receiver unit in the otoplastic 13.

The adapter 14 essentially has a fixing component 14*a* into which is taken the sound output 12 of the receiver 11, as well as a sound output part 14*b* that defines an outlet direction of the sound transmitted by the adapter 14. The adapter 14 is usually designed in such a way that a preferred sound outlet direction determined by the sound output 12 of the receiver 11 is not influenced by the adapter 14. Because this results in a non-optimal coupling of the output sound into the auditory canal 16, the basic idea here consists in designing the adapter 14 so that the preferred sound outlet direction originally defined by the sound output 12 of the receiver 11 is diverted by way of the adapter 14. To this end the sound output part 14*b* of the adapter 14 is realized at an angle to the fixing component 14*a* so that the adapter 14 has a curvature.

As shown in FIG. 2 the curvature of the adapter 14 enables better orientation of the sound generated by the receiver 11 vis-à-vis the auditory canal 16. It is apparent that the sound is output not against a side of the auditory canal 16 but is instead output on to the auditory canal 16 such that the sound can be propagated directly to an eardrum. Reflections of the sound against the wall of the auditory canal 16 are thus avoided.

In order to protect the receiver, specifically the sound output 12, a cerumen protection device 15 having an integrated cerumen protection element 20 is furthermore inserted in the otoplastic 13 between the adapter 14 (more precisely the sound output part 14*b*) and a sound outlet opening 17. This cerumen protection device 15 substantially extends the structure of the receiver device 9 so that, in the case of the conventional solution with an adapter that is straight in design, the insertion of the cerumen protection device can be problematic. As can be seen in FIG. 2, subtle curvature of the adapter 14 enables the cerumen protection device 15 to be inserted without problems. Furthermore a larger receiver 11 can be built into the receiver device 9 in support of greater amplification of the sound.

Figure 3:
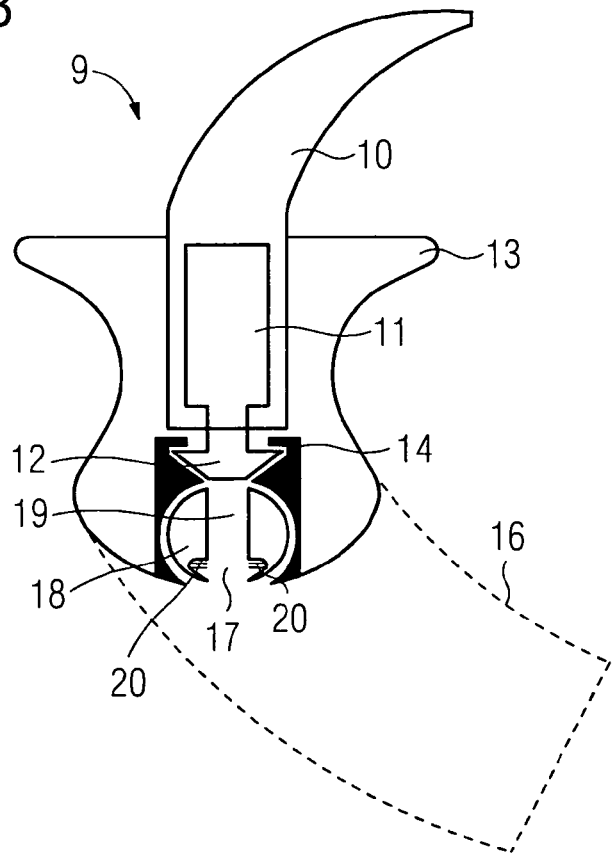
FIG. 3 shows an inventive receiver device according to a second exemplary embodiment.
Figure 4:
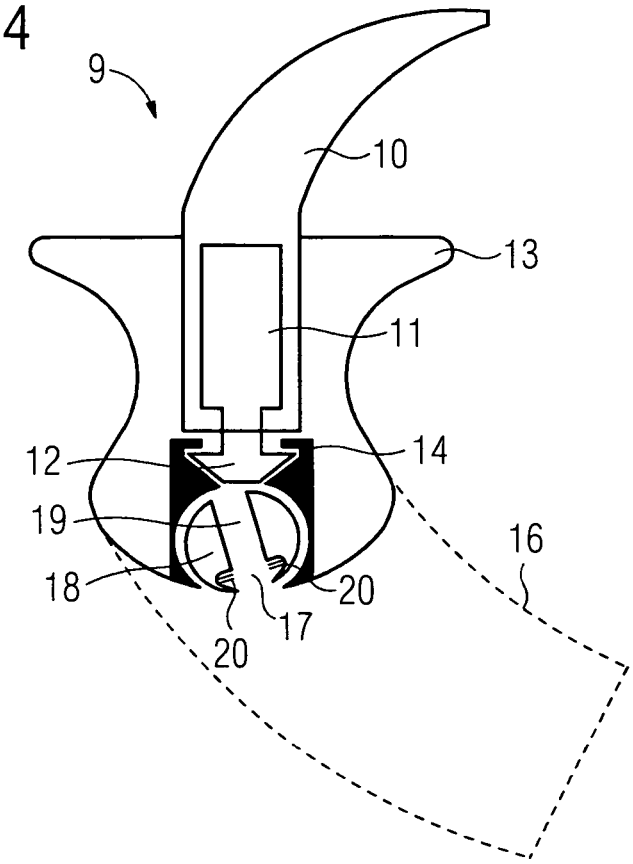
FIG. 4 shows the inventive receiver device according to the second exemplary embodiment with a changed sound outlet angle.
Figure 5:
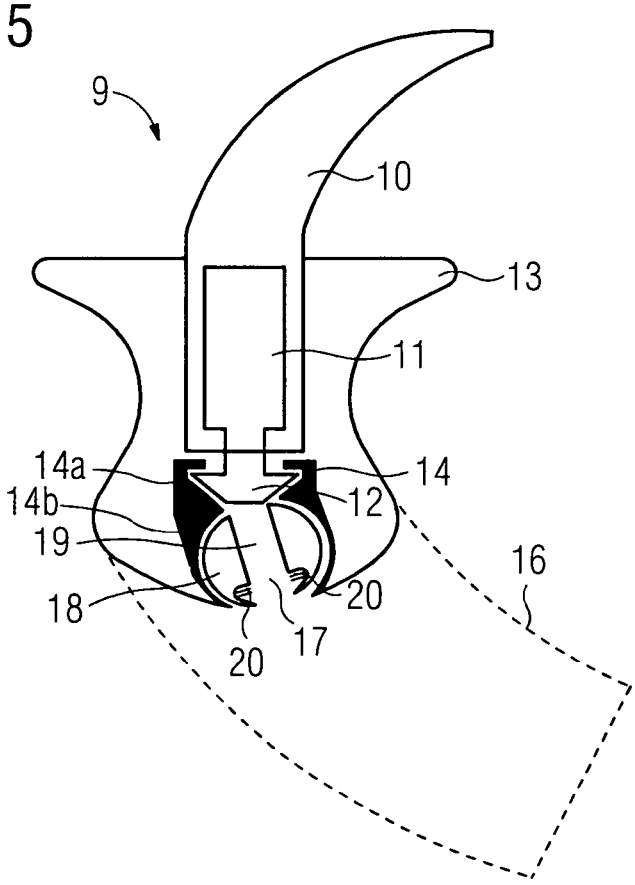
FIG. 5 shows an inventive receiver device according to a third exemplary embodiment.

According to a second exemplary embodiment of the inventive receiver device 9 a diversion of the propagation direction of the sound generated by the receiver 11 can be realized by means of a spherical directing element 18. This embodiment of the receiver device 9 (shown in FIG. 3) is especially suited to less-strongly curved auditory canals (for strongly curved auditory canals cf. third exemplary embodiment, FIG. 5). The spherical directing element 18 is mounted rotatably in the adapter 14 so that the sound outlet direction can be diverted in any desired direction. The spherical directing element 18 is shown in a rotated position in FIG. 4. The sound generated by the receiver 11 is conducted through an end-to-end opening 19 in the spherical directing element 18, with said opening 19 here being the sound outlet opening 17. The spherical directing element 18 is aligned so that the sound is conducted directly to the eardrum. In addition the spherical directing element 18 is realized such that it performs the cerumen protection function. The cerumen protection element 20 is integrated into the spherical directing element 18.

According to a third exemplary embodiment (shown in FIG. 5) of the receiver device 9 the spherical directing element 18 is also inserted in addition to the curved adapter 14. The use of this embodiment lends itself to a strongly curved auditory canal 16. It must be borne in mind here that the curvature of the adapter 14 cannot be designed in any fashion desired. There are difficulties here when inserting a very strongly curved adapter 14 into the otoplastic 13. In the receiver device 9 shown in FIG. 5 the sound direction can be diverted on the one hand by the adapter 14 and on the other hand by the spherical directing element 18 so that an optimal overall orientation of the sound to match the auditory canal 16 is achieved.

The invention claimed is:

1. A receiver device for a hearing apparatus comprising:

an earpiece that secures the receiver device in an auditory canal;

a receiver having a sound outlet direction; and an adapter that affixes the receiver in the earpiece, a sound from the receiver being conducted through the adapter, the adapter diverts the sound from the sound outlet direction in a divergent direction, wherein the adapter is formed in a bellow shape, wherein the adapter includes a spherical directing element with an end-to-end opening that allows sound to pass through, wherein the spherical directing element is mounted rotatably in the adapter, wherein the spherical directing element includes an end-to-end opening forming a sound outlet opening of the earpiece, and wherein the spherical directing element diverts the sound from the sound outlet direction in the divergent direction.

2. The receiver device as claimed in claim 1, wherein a cerumen protection element is integrated in the adapter.

3. A receiver device for a hearing apparatus, comprising:

an earpiece that secures the receiver device in an auditory canal;

a receiver having a sound outlet direction; and an adapter that affixes the receiver in the earpiece, a sound from the receiver being conducted through the adapter, the adapter diverts the sound from the sound outlet direction in a divergent direction, wherein a spherical directing element with an end-to-end opening that allows sound to pass through, wherein the spherical directing element is mounted rotatably in the adapter, wherein the end-to-end opening in the spherical directing element forms a sound outlet opening of the earpiece, and wherein the spherical directing element diverts the sound from the sound outlet direction in the divergent direction.

4. The receiver device as claimed in claim 3, wherein the adapter is formed in a curve in order to divert the sound from the sound outlet direction in the divergent direction.

5. The receiver device as claimed in claim 4, wherein the curve is realized by a bellow shape.

6. The receiver device as claimed in claim 3, wherein a cerumen protection element is integrated in the spherical directing element.

7. A receiver device for a hearing apparatus, comprising:

an earpiece that secures the receiver device in an auditory canal;

a receiver having a sound outlet direction; and an adapter that affixes the receiver in the earpiece, a sound from the receiver being conducted through the adapter, the adapter formed in a curve in order to divert the sound from the sound outlet direction in the divergent direction, wherein the curve is facilitated by a spherical directing element, wherein the spherical directing element has an end-to-end opening that allows sound to pass through, wherein the spherical directing element is mounted rotatably in the adapter, wherein the end-to-end opening in the spherical directing element forms a sound outlet opening of the earpiece, and wherein the spherical directing element diverts the sound from the sound outlet direction in the divergent direction.

* * * * *